United States Patent [19]

Gartner

[11] Patent Number: 4,648,255

[45] Date of Patent: Mar. 10, 1987

[54] LOCK PROTECTING DEVICE FOR HIGH SECURITY SAFES

[76] Inventor: Klaus W. Gartner, 2632 Via Anacapa, Palos Verdes Estates, Calif. 90274

[21] Appl. No.: 649,666

[22] Filed: Sep. 12, 1984

[51] Int. Cl.[4] ..... E05B 15/16; E05B 63/00

[52] U.S. Cl. ..... 70/417; 70/1.5; 70/422

[58] Field of Search ..... 109/30, 41, 42, 81, 109/49.5; 70/417, 422, 1.5, 333 R

[56] References Cited

U.S. PATENT DOCUMENTS

| | | | |
|---|---|---|---|
| 40,947 | 12/1863 | Rogers | 109/81 |
| 261,533 | 7/1882 | Corliss . | |
| 881,032 | 3/1908 | Schultz . | |
| 1,452,567 | 4/1923 | Miller et al. | 70/1.5 |
| 1,607,426 | 11/1926 | Bell et al. . | |
| 2,938,374 | 5/1960 | Criscuolo et al. | 70/417 X |
| 2,970,217 | 1/1961 | Enikeieff | 70/333 R X |
| 3,371,628 | 3/1968 | McClellan | 109/59 |
| 3,735,714 | 5/1973 | Shoop | 70/417 X |
| 3,844,019 | 10/1974 | Shwayder et al. . | |
| 3,976,434 | 8/1976 | Shwayder . | |
| 4,147,044 | 4/1979 | Bernath | 70/1.5 X |
| 4,470,275 | 9/1984 | Fisher | 70/1.5 |
| 4,520,736 | 6/1985 | Crosby et al. | 70/1.5 X |

FOREIGN PATENT DOCUMENTS

| | | | |
|---|---|---|---|
| 255731 | 6/1931 | Australia | 70/1.5 |
| 2557151 | 6/1976 | Fed. Rep. of Germany . | |
| 2933026 | 2/1981 | Fed. Rep. of Germany | 109/81 |
| 828293 | 2/1960 | United Kingdom . | |
| 883005 | 11/1961 | United Kingdom . | |

*Primary Examiner*—Robert L. Wolfe
*Assistant Examiner*—Russell W. Illich
*Attorney, Agent, or Firm*—Poms, Smith, Lande & Rose

[57] ABSTRACT

A lock protecting device for high security safes uses two hardened-material plates between which ball bearings have been nested in an egg-crate fashion. The plates with the safe's lock works mounted thereon are mounted to the interior of the safe door in order to present consecutive barriers to an intruding drill bit. Another plate is mounted to the rear of the lock works such that an intruding drill bit will lastly strike this plate causing it to break away, thereby releasing a plunger into engagement with the locking bolt and preventing opening of the safe door even if the rest of the lock works are manipulated into their unlocked state.

5 Claims, 10 Drawing Figures

LOCK PROTECTING DEVICE FOR HIGH SECURITY SAFES

FIELD OF THE INVENTION

In general, the present invention relates to security locks of safes and vaults. More particularly, the present invention relates to a lock protecting device, mounting a lock and its associated lock works interiorly of the safe door in a manner which will resist and impede unauthorized access, such as by drilling through the safe door.

BACKGROUND OF THE INVENTION

It is common to provide combination locks in safe doors in the manner illustrated in prior U.S. Pat. No. 4,142,388. In such arrangements, the lock works are mounted to an interior surface of the safe door with an opening device, such as a lock dial and manually operated handle, positioned exteriorly of the door. Persons wishing to gain unauthorized entry into the safe recognize that the lock works are generally located behind the lock dial and attempt to defeat the lock by drilling holes through the dial, safe door, lock housing and lock works. Then through the use of probes, picks and the like, the lock works can be manipulated to cause release of the associated latch or bolt from the safe wall or keeper which receives the latch, thusly allowing easy access the contents of the safe.

It is, therefore, the primary object of the present invention to provide a protecting device for impeding and preventing the unauthorized intrusion into the lock works as by drilling through the safe door.

It is also an object of the present invention to provide a means for easily mounting a lock housing and associated lock works to the interior of the safe door in association with the protecting device stated, such that normal, authorized manipulation of the lock is not hindered.

SUMMARY OF THE INVENTION

Generally stated, the present invention is a protecting device for an interiorly mounted lock mechanism in a safe door, such as the type which uses a locking bolt to prevent access. More specifically, a pair of abutting members, having a plurality of opposed cavities each of which contain a ball of hardened material, are mounted between a lock operating mechanism and the exterior of the associated safe door, whereby attempted drilling through the safe door into the mechanism is impeded by the presence of the balls. A plunger is mounted in one of said abutting members for release in response to the drilling to thereby prevent unlocking motion of the mechanism.

In the exemplary embodiment, a first plate-like body abuts the interior surface of the safe door. The plate has a hole to receive, for example, a shaft which extends through an access in the door for manipulating the internal lock works via an external dial. A second plate-like body, having a similar hole axially aligned with that of the first plate-like body, is used to mount the lock housing and associated lock works to the first plate-like body and, thereby, to an interior surface of the safe door. The abutting surface of the first and second plates carry multiple, mirror image indentations into which balls of hardened material, such as ball bearings, are nested. Hence, an unauthorized intrusion, such as by drilling will result in the drill bit successively contacting the first plate-like body, the ball bearings, and then second plate-like body before reaching the lock housing. Should the perpetrator succeed in penetrating the two bodys and the intersticed ball bearings with the drill bit, it would dislodge a release plate on the lock housing. A plunger in the second body is released by the plate to engage the locking bolt and, thereby, to prevent withdrawal of the locking bolt so as to gain access to the interior of the safe.

Other objects, features, and advantages of the present invention will become apparent to those skilled in the art upon consideration of the following detailed description and the accompanying drawings.

DETAILED DESCRIPTION OF THE INVENTION

Figure 2:
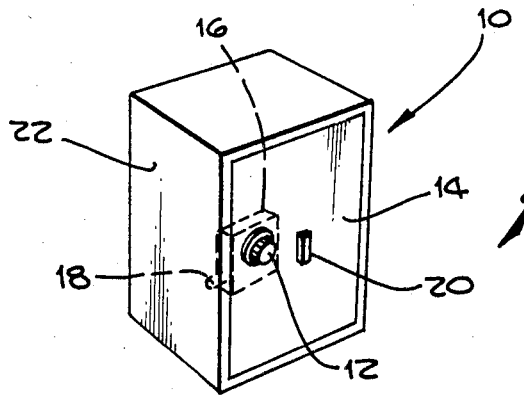
FIG. 2 is a perspective view of the exterior of a safe of the type contemplated for incorporation of the device of FIG. 1, which is shown generally in phantom outline.

The preferred exemplary embodiment of the present invention is a lock protecting device described herein is contemplated for use with a high security safe 10, as shown for example in FIG. 2, having a combination lock dial 12 mounted externally on the safe door 14 for controlling the lock works, shown generally in phantom lines at 16. The combination lock works 16 may be constructed as more fully explained in U.S. Pat. No. 4,142,388. Generally, such a lock includes an internal, sliding-type, locking bolt 18, adapted for insertion into an opening in the safe wall 22 or for positioning behind an interior locking jamb 24 extending inwardly from the wall 22. For the purposes of this disclosure, the term "inwardly" shall always denote the direction generally toward the center of the safe cavity; the term "outwardly" shall denote the direction as viewed from the safe cavity looking through the safe door opening. The preferred embodiment is described in conjunction with such a combination lock mechanism whereby a shaft (not shown) through an access (not shown) in the door 14 operably connects the dial 12 to the lock works 16. The present invention is also amenable to use in conjunction with key and key-hole access, or other such conventional locking mechanisms for manipulating the lock works 16.

Figure 3:
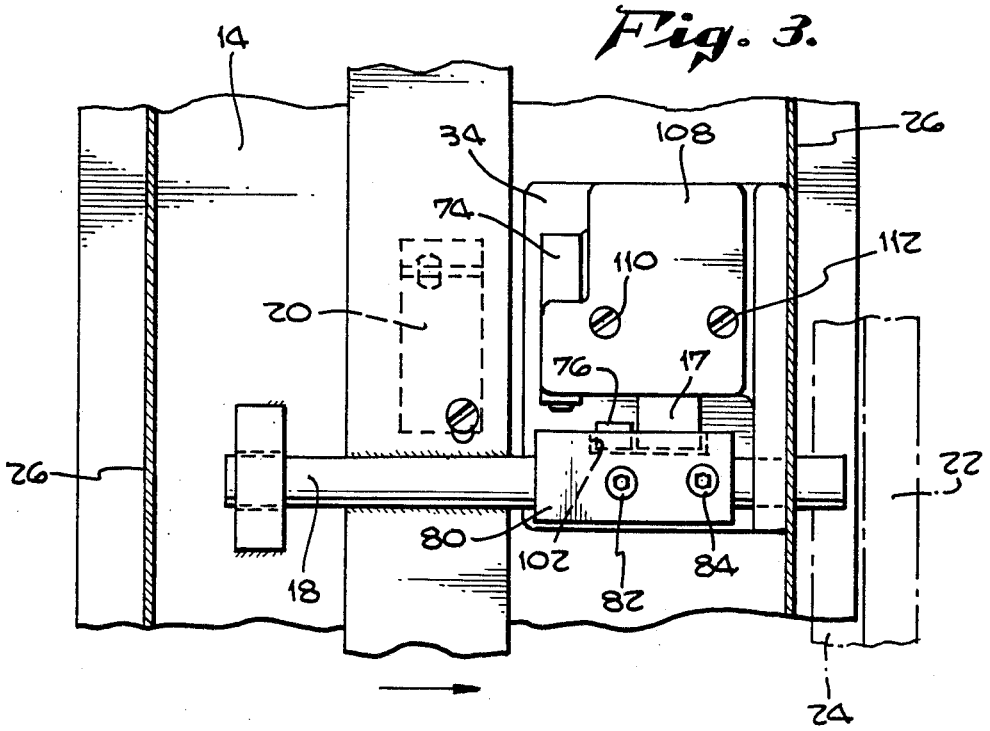
FIG. 3 is a plan view of the device of FIG. 1 as incorporated in a safe door as viewed from the interior of a safe with the lock works in their locked position.
Figure 4:
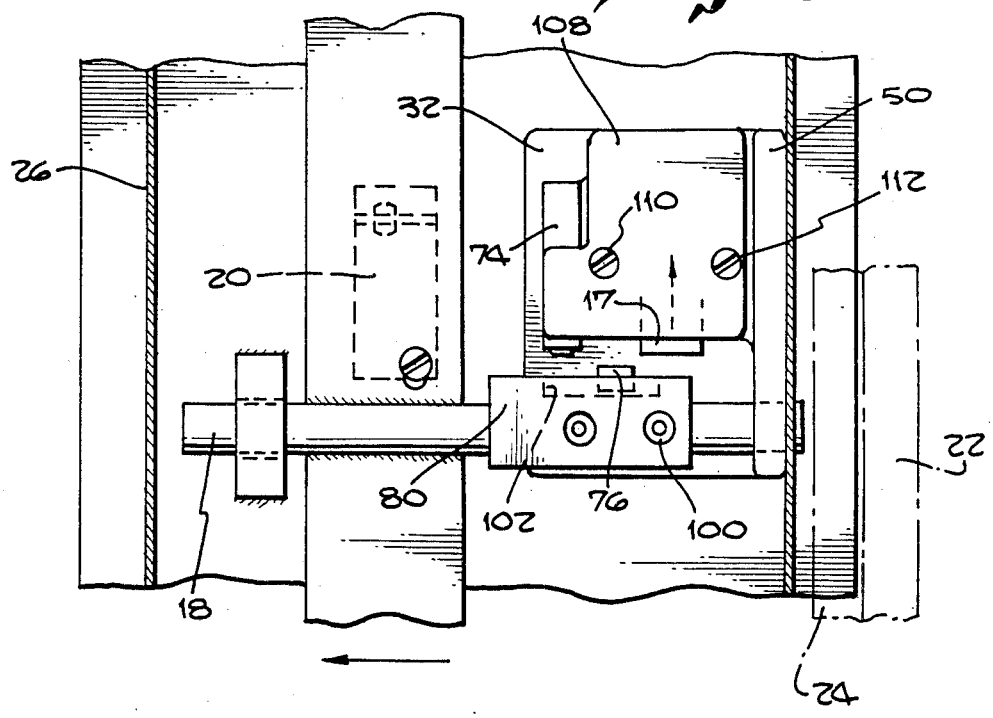
FIG. 4 is a plan view of the device of FIG. 1 as incorporated in a safe door as viewed from the interior of the safe with the lock works in their unlocked position.
Figure 5:
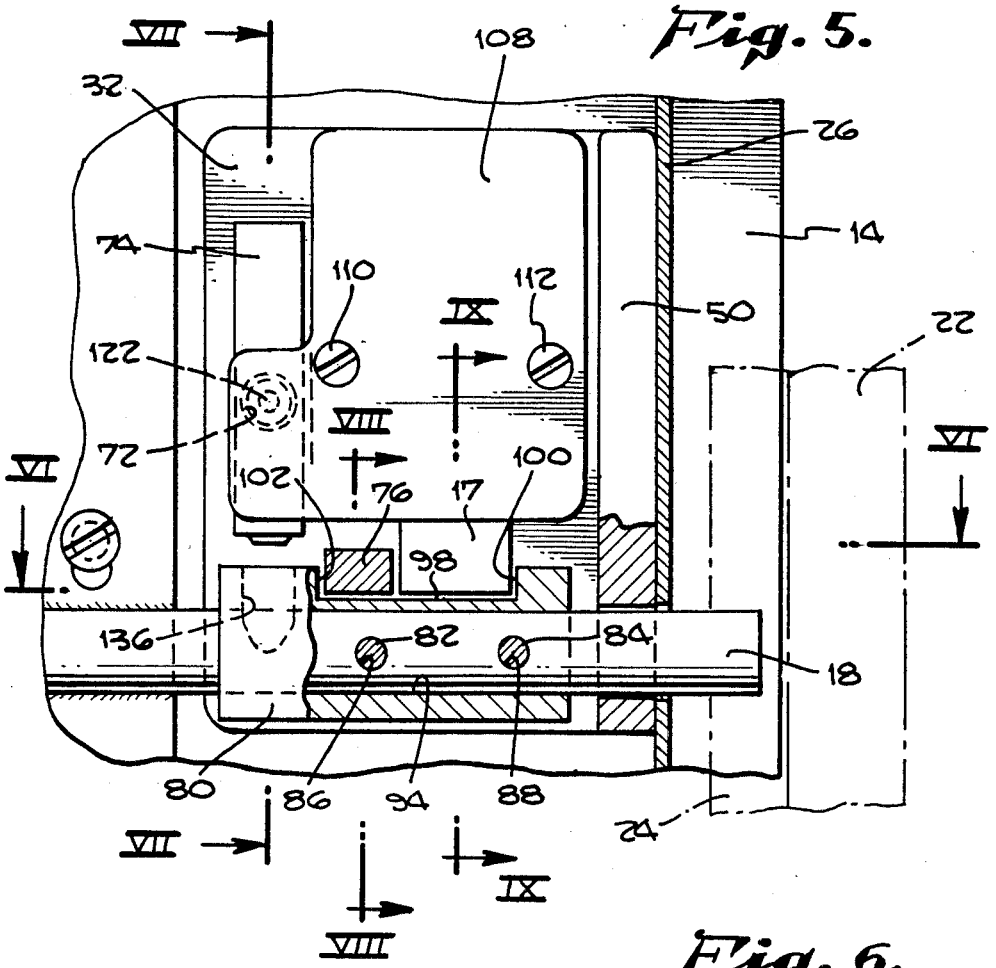
FIG. 5 is a detail section view of the configuration of a portion of the exemplary embodiment and the lock works of FIG. 3.

As seen generally in FIGS. 3 and 4, a handle mechanism 20 penetrates the safe door 14 and is connected to a locking bolt 18 in a manner common to the state-of-the art. In the locked position, FIG. 3, the locking bolt 18 prevents the opening of the door 14 by being in overlapping contact with a locking jamb 24. In the unlocked position, FIG. 4, the locking bolt 18 is retracted by the handle mechanism 20, thereby clearing the locking jamp 24 and allowing the door 14 to be opened freely.

As mentioned hereinbefore, it has been found that persons attempting an unauthorized entry into the safe 10 may attempt to drill into the lock works 16 in order to manipulate it by using the dial 12 and probes or picks inserted through openings drilled through the door 14 to achieve withdrawal of the locking bolt 18 from engagement with the safe wall 22 or a locking jamb 24. As particularly contemplated within the present invention, a lock protecting first plate 30 and a lock protecting second plate 32 are interposed between the lock work housing 26 and the interior surface of the safe door 14 in a position to resist anticipated efforts to drill through the door 14 in the area of the lock dial 12.

The first plate 30 is formed of a hardened material and has a hole 34 for alignment with the access in the door 14 to receive the shaft which will connect the dial 12 to the lock works 16. The outwardly facing surface 35 of first plate 30 is generally planar. On the inwardly facing surface 36 of the first plate 30, there is provided a multiplicity of indentations 38 which can be generally hemispherical in shape. Said indentations are designed to allow a hardened steel ball bearing 40 of slightly smaller outside diameter than the inner diameter of the indentations to be nested and freely rotatable in each of them.

Figure 6:
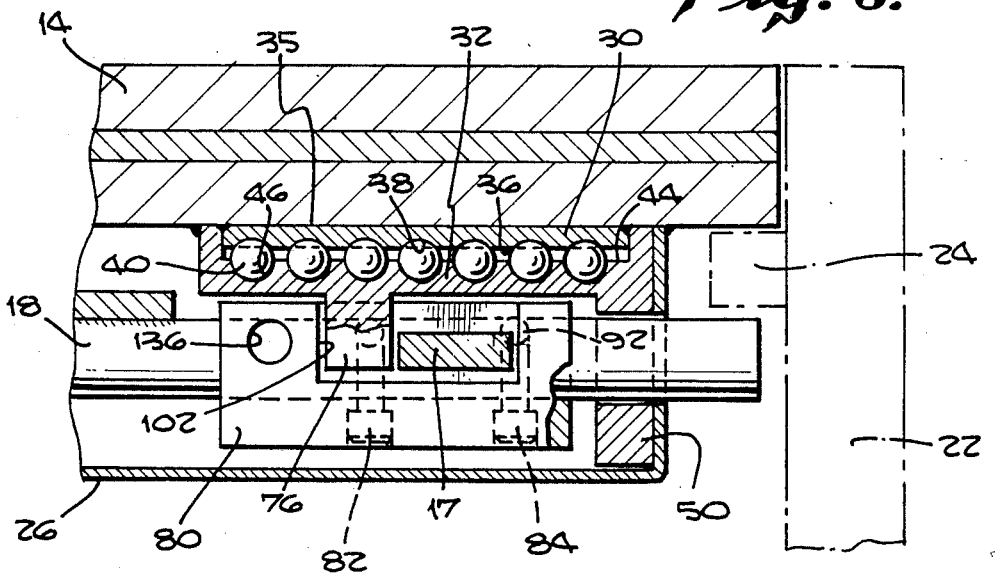
FIG. 6 is an elevation view of the exemplary embodiment with a portion of the lock works taken in plane VI—VI of FIG. 5.

The second plate 32 is also formed of a hardened material. A hole 42 is located in the second plate 32 for alignment with the hole 34 in the first plate 30 and the access in the door 14 in order to receive the dial shaft. Referring briefly to FIG. 6, on the outwardly facing surface 44 of the second plate 32, which lies adjacent the inner surface 36 of first plate 30, there is provided a multiplicity of indentations 46 which are designed to provide a matching counterpart to the indentations 38 of the first plate 30, for receiving that portion of the ball bearings 40 protruding inwardly from the surface 36 of the first plate 30.

The inwardly facing surface 48 of the second plate 32 has an inwardly facing end flange 50 to be aligned parallel and adjacent to the safe wall 22 or the safe door locking jamb 24. At the lower end 52 of the flange 50, there is provided a guide hole 54, with its center axis oriented parallel to the inwardly facing surface 48, for the locking bolt 18. This surface 48 also has an inwardly facing, raised table section 56 adjacent to the end flange 50, providing the capability of mounting the lock works housing 26 thereon, such as by rivets or bolts through apertures 58. The shaft hole 42 passes through this section 56 of the second plate 32 in alignment with an access through the lock works housing 26 such that the dial shaft can be connected between the combination dial 12 and the lock works 16 contained in the housing 26 through the safe door 14, the first plate hole 34, and the second plate hole 42.

Figure 7:
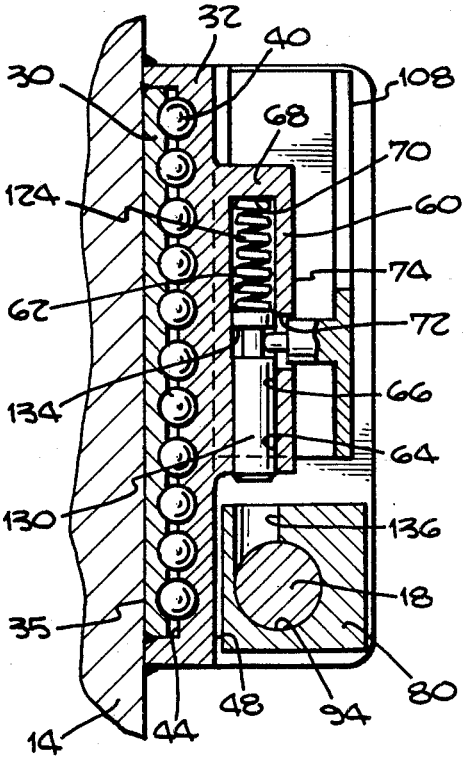
FIG. 7 is a cross-sectional detail view of a portion of the exemplary embodiment and the lock works of FIG. 5 taken in plane VII—VII.

Formed integrally with the table section 56 on the side opposite the flange 50 of the second plate 32, is an inwardly extending plunger guide flange 60. Turning briefly to FIG. 7, the plunger guide flange 60 has a vertically oriented plunger cavity 62 having an opening 64 at its bottom end 66. At the top end 68 of the guide flange 60, the cavity 62 forms an upper wall 70. At approximately the midpoint of the guide flange 60, a transverse bore 72 extends inwardly from the cavity 62 through the inwardly facing surface 74 of the flange 60.

Also, on said inner surface 48, spaced slightly below the table 56 between the flanges 50 and 60 and adjacent flange 60, is an inwardly extending lock bar tab 76. The function of this tab 76 will become clearer with the explanation of the operation of the present invention given below.

Figure 8:
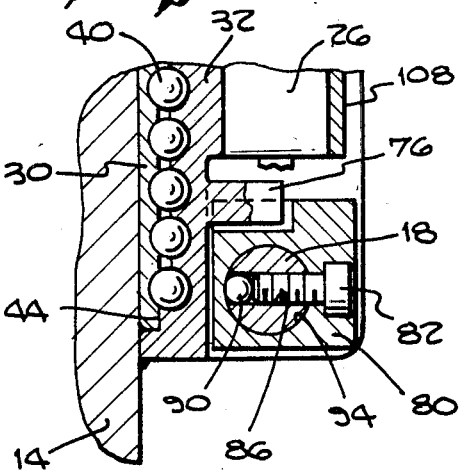
FIG. 8 is a cross-sectional detail view of a portion of the exemplary embodiment and the lock works of FIG. 5 taken in plane VIII—VIII.
Figure 9:
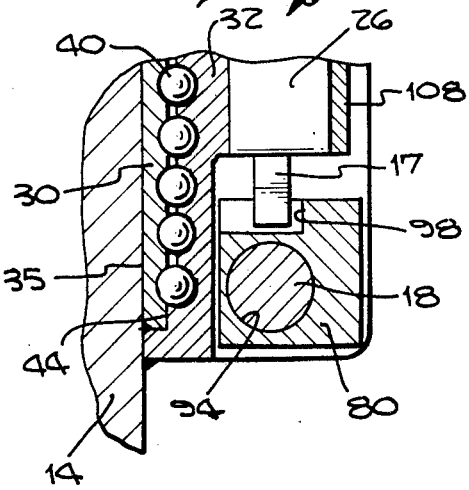
FIG. 9 is a cross-sectional detail view of a portion of the exemplary embodiment and the lock works of FIG. 5 taken in plane IX—IX.

Referring briefly to FIGS. 6 and 8, a locking bar 80 is fixedly mounted to the locking bolt 18 via two recessed set screws 82, 84 which engage partially tapped holes 86, 88, respectively, in the locking bolt 18. As a further preventive to unauthorized access to the safe 10 by drilling through the door 14 below the lock works 16 in an attempt to free the locking bolt 18 directly, ball bearings 90, 92 are set in the bottom of the tapped holes 86, 88, respectively, in order to foul any intruding drill bit.

The locking bar 80 has an axial bore 94 through which the locking bar 18 slidingly fits. In the upper surface 96 of the locking bar 80 is an outwardly opening recess 98 which forms inner vertical walls 100 and 102 parallel to the flanges 50 and 60. Also extending down through the upper surface 96 and into the axial bore 94, is a plunger hole 104.

The locking bar 80, when operationally mounted on the locking bar 18 in its locked condition, is oriented inwardly adjacent the second plate 32 such that the axial bore 94 is aligned with the bolt guide hole 54 in the flange 50; the outwardly opening recess 98 encaptures the lock bar tab 76; and the plunger hole 104 underlies the opening 64 of the plunger cavity 62. As best exemplified in FIGS. 3–6 and 8, the tab 76 is of a generally rectangular shape and size such that it extends non-interferingly into recess 98 of the lock bar 80. As shown in FIG. 3, however, at the interface of the tab 76 with the recess wall 102, the tab 76 limits the travel of the lock bar 80, and hence the bolt 18, toward the locked position of the safe door 14.

Figure 1:
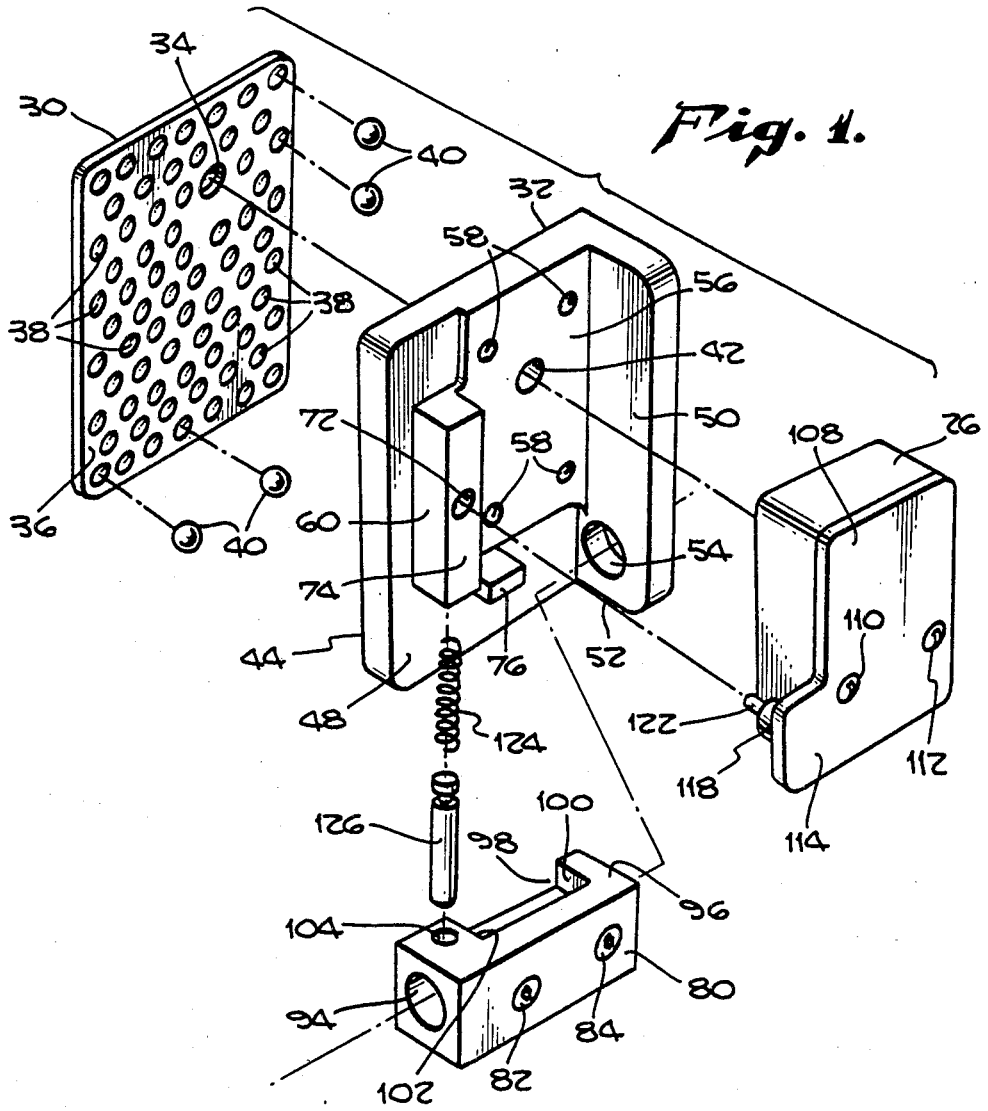
FIG. 1 is an exploded perspective view of an exemplary embodiment of the lock protecting device of the present invention illustrated in orientation with a lock housing and locking bar.
Figure 10:
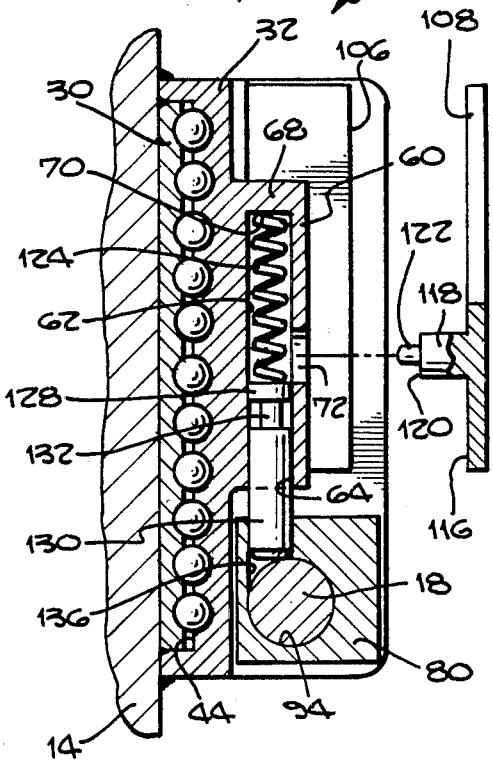
FIG. 10 is a cross-sectional detail view of a portion of the exemplary embodiment and the lock works of FIG. 5 taken in plane VII—VII but with the plunger released into engagement with the locking bar and bolt of the lock works.

Referring now to FIGS. 1, 7 and 10, the lock works housing 26 carries on its inwardly facing surface 106, a plunger release plate 108 secured to the housing 26 by two breakaway screws 110, 112. The plunger release plate 108 has an extension portion 114 designed to overlay the surface 74 of the flange 60 when the housing 26 is mounted on the table 56 of the inwardly facing surface 48 of the second plate 32. On the outwardly facing surface 116 of the release plate 108 is an outwardly extending plunger release pin 118. On its outwardly directed face 120, the release pin 118 has an outwardly protruding finger 122. When secured as described, the pin 118 is oriented so as to extend into, but not completely through, the bore 72 in the flange surface 74. However, the finger 122 extends a short distance beyond the bore 72 and into the cavity 62 of the flange 60.

As best seen in FIG. 7, located within the cavity 62 in abutting relationship with the top wall 70, is a spring 124. A plunger 126 fits slidingly in the cavity 62 for protrusion through the opening 64 in the bottom of the flange 60. The plunger 126 has a cap 128 at its upper extremity upon which the spring 124 sits. The cap 128 is fixedly attached to the plunger body 130 with a connecting rod 132. The rod 132 has a cross-sectional diameter narrower that the cap 128 and body 130 such that with the spring 124 compressed between the top wall 70 and cap 128 (as shown in FIG. 7), the finger 72 will contact the bottom surface 134 of the cap 128, thereby holding the plunger 130 within the cavity 66 so as not to interfere with the locking bar 80 and bolt 18.

Fully assembled operation of the present invention within a safe 10 as used with lock works 16 mounted on the second plate 32 as described above, is best exemplified with reference to FIGS. 3, 4, 7 and 10. In FIG. 3, the assembly is shown in the safe door 14 locked position. The handle 20 is used to throw the locking bolt 18 to this position such that it inwardly abuts the locking jamb 24, preventing the opening of the safe door 14. The lock works 16 within the lock works housing 26 are set and drop a latch 17 into the recess 98 of the locking bar 80, thereby occupying that portion of the recess 98 adjacent to the locking bar tab 76 of the second plate 32. As the locking bar 80 is fixedly attached to the locking bolt 18, withdrawing motion of the bolt 18 by manipulation of the handle 20 is prevented until the latch 17 is raised, as shown in FIG. 4, by operation of the lock works 16 using the combination dial 12.

If a drill is used on the dial 12 or door 14, the lock protecting device first plate 30, being constructed of a hardened-material, presents the first major obstruction to further unauthorized intrustion. If the drill bit does penetrate the first plate 30, it next encounters the ball bearings 40 nested in the indentations 38 and 46. The free rotation of the balls 40 further impede the drilling attempt. Assuming the perpetrator gets through the layer of ball bearings 40, his drill is next obstructed by the hardened-material second plate 32. Once through the second plate 32, the drill next would penetrate the lock works housing 26 and the contained lock works 16. Relying on a lack of further resistance to inform him when the drill bit has passed throught the works 16 so as to afford a passage sufficient to accomodate to probe or pick used to manipulate the lock works 16, the perpetrator would no doubt continue to drill until the bit contacts the release plate 108 on the inward side of the lock works housing 26. Such contact will cause the breakaway screws 110, 112 to release; the plate 108 will be separated from the housing 26, as shown in FIG. 10, drawing pin 118 and attached finger 122 out of the flange 60.

Once the finger 122 clears the cap bottom 134, the spring 124 will force the plunger body 130 through the opening 64 in the flange 60. As the cavity 62 has been oriented to be directly above the plunger hole 104 in the locking bar 80, a portion of the plunger body 130 enters the hole 104 and proceeds downward into an aligned cavity 136 in the locking bolt 18. As shown in FIG. 10, a portion 138 of the plunger body 130 remains in the flange cavity 62. Hence, even if the perpetrator succeed in "picking" the lock works, the bolt 18 is prevented from withdrawal by the interference caused by the plunger body 126. At this point, the perpetrator would probably have to resort to explosives to gain access to the safe.

In the foregoing description of the present invention, a preferred embodiment has been disclosed. It is to be understood that other design variations, modifications, adaptations and alterations are within the scope of the present invention.

What is claimed is:

1. An improved multi-function universal plate for protecting a safe lock operating mechanism having a locking bolt from unauthorized forced access compressing:

a mounting pad on said mounting plate front surface having a dial spindle receiving aperture;

a bolt journal supporting means for supporting movement of said locking bolt wherein said journal further comprises a guiding aperture for slidingly movement of said bolt in one direction through said aperture causing the bolt to engage a door jamb and the slidingly movement in said opposite direction causes disengagement with said door jamb;

a locking bar affixed to said locking bolt having a recess for the insertion of a locking latch when activated by a first locking mechanism and a plunger hole for the insertion of a plunger associated with a second locking mechanism;

a plurality of cavities provided on said mounting plate back surface with an internal diameter of a first diameter for the receipt of balls of hard material of a second diameter, said diameter being less than said first diameter; and a second locking mechanism for relocking the safe when the first locking means is defeated from unauthorized forced access to said first locking mechanism.

2. The improved multi-function universal plate of claim 1 where said second locking mechanism comprises:

a plunger means, releasably mounted on said plate, for release in response to said unauthorized forced access, for preventing motion of said first locking mechanism.

3. The improved multi-function universal plate of claim 2 wherein said plunger means further comprises:

a plunger guide flange affixed upon said plate with a first bore therein for a spring actuated plunger pin;

a second bore at an angle to the first bore for a frangible means for normally holding said plunger from moving under the bias of the spring;

whereby said flangible means is releasably attached to said first locking mechanism for actuating said plunger pin to protect the safe from intrusion.

4. The improved multi-function universal plate of claim 1 wherein said plate comprises a hardened material.

5. An improved multi-function universal plate for protecting a safe locking mechanism having a locking bolt from unauthorized forced access comprising:

a bolt journal supporting means for supporting movement of said locking bolt comprising a guiding aperture for the slidingly movement of said locking bolt in one direction through said aperture causing the bolt to engage a door jamb on an associated safe and the slidingly movement in said opposite direction causing disengagement with said door jamb;

a relocking means for relocking said safe when a first locking mechanism is defeated from unauthorized forced access to the first locking mechanism;

means for affixing said plate to a safe door; and a locking bar affixed to said locking bolt having a recess for the insertion of a locking latch when activated by said safe first locking mechanism, and a plunger hole for the insertion of a plunger associated with said relocking means.

* * * * *